US009328876B2

(12) United States Patent
Wilcox et al.

(10) Patent No.: US 9,328,876 B2
(45) Date of Patent: May 3, 2016

(54) HIGH EFFICIENCY LED LAMP

(71) Applicant: Cree, Inc., Durham, NC (US)

(72) Inventors: Kurt Wilcox, Libertyville, IL (US); Bernd Keller, Santa Barbara, CA (US); James Ibbetson, Santa Barbara, CA (US); Ashish Ekbote, Carpinteria, CA (US); Nalini Gupta, Santa Barbara, CA (US)

(73) Assignee: Cree, Inc., Durham, NC (US)

( * ) Notice: Subject to any disclaimer, the term of this patent is extended or adjusted under 35 U.S.C. 154(b) by 240 days.

(21) Appl. No.: 14/219,627

(22) Filed: Mar. 19, 2014

(65) Prior Publication Data

US 2015/0267879 A1 Sep. 24, 2015

(51) Int. Cl.

| | |
|---|---|
| ***F21K 99/00*** | (2016.01) |
| *F21Y 101/02* | (2006.01) |
| *F21Y 103/00* | (2016.01) |
| *F21Y 113/00* | (2016.01) |

(52) U.S. Cl.

CPC ... *F21K 9/56* (2013.01); *F21K 9/17* (2013.01); *F21Y 2101/02* (2013.01); *F21Y 2103/003* (2013.01); *F21Y 2113/007* (2013.01)

(58) Field of Classification Search

CPC ..... F21K 9/56; F21K 9/17; F21Y 2101/02; F21Y 2103/003; F21Y 2113/007

See application file for complete search history.

(56) References Cited

U.S. PATENT DOCUMENTS

| | | | | |
|---|---|---|---|---|
| 5,688,042 | A | 11/1997 | Madadi et al. | |
| 6,853,151 | B2 | 2/2005 | Leong et al. | |
| 6,860,628 | B2 | 3/2005 | Robertson et al. | |
| 6,936,968 | B2 | 8/2005 | Cross et al. | |
| 7,048,410 | B2 | 5/2006 | Kutler | |
| 7,049,761 | B2 | 5/2006 | Timmermans et al. | |
| 7,114,830 | B2 | 10/2006 | Robertson et al. | |
| 7,213,940 | B1 * | 5/2007 | Van De Ven | F21K 9/00 257/89 |
| 7,307,391 | B2 | 12/2007 | Shan | |
| 7,510,299 | B2 | 3/2009 | Timmermans et al. | |
| 7,815,338 | B2 | 10/2010 | Siemiet et al. | |
| 7,926,975 | B2 | 4/2011 | Siemiet et al. | |
| 7,976,196 | B2 | 7/2011 | Ivey et al. | |
| 8,058,659 | B2 | 11/2011 | Bisberg | |
| 8,093,823 | B1 | 1/2012 | Ivey et al. | |
| 8,115,411 | B2 | 2/2012 | Shan | |
| 8,118,447 | B2 | 2/2012 | Simon et al. | |
| 8,247,985 | B2 | 8/2012 | Timmermans et al. | |
| 8,282,247 | B2 | 10/2012 | Ivey et al. | |
| 8,324,817 | B2 | 12/2012 | Ivey et al. | |

(Continued)

FOREIGN PATENT DOCUMENTS

| | | | |
|---|---|---|---|
| JP | H08162677 | A | 6/1996 |
| JP | 2007059930 | A | 3/2007 |

(Continued)

OTHER PUBLICATIONS

U.S. Appl. No. 29/467,949, filed Sep. 25, 2013.

(Continued)

*Primary Examiner* — Mary Ellen Bowman

(74) *Attorney, Agent, or Firm* — Dennis J. Williamson; Moore & Van Allen PLLC

(57) ABSTRACT

A LED lamp includes a plurality of red LEDs and a plurality of blue LEDs, a phosphor covering at least the plurality of blue LEDs, where the lamp has an LPW of at least 200 in a steady state operation.

29 Claims, 4 Drawing Sheets

(56) References Cited

U.S. PATENT DOCUMENTS

| | | | | |
|---|---|---|---|---|
| 8,360,599 | B2 | 1/2013 | Ivey et al. | |
| 8,362,710 | B2 | 1/2013 | Langovsky | |
| 8,382,327 | B2 | 2/2013 | Timmermans et al. | |
| 8,419,223 | B2 | 4/2013 | Withers | |
| 8,421,366 | B2 | 4/2013 | Palazzolo et al. | |
| 8,449,137 | B2 | 5/2013 | Dassanayake et al. | |
| 8,482,212 | B1 | 7/2013 | Ivey et al. | |
| 8,573,813 | B2 | 11/2013 | Ivey et al. | |
| 8,596,813 | B2 | 12/2013 | Ivey | |
| 2002/0060526 | A1 | 5/2002 | Timmermans et al. | |
| 2007/0279903 | A1* | 12/2007 | Negley | F21S 8/02 362/230 |
| 2009/0217970 | A1* | 9/2009 | Zimmerman | F21K 9/00 136/252 |
| 2011/0133222 | A1* | 6/2011 | Allen | F21K 9/137 257/88 |
| 2011/0310587 | A1* | 12/2011 | Edmond | F21K 9/135 362/84 |
| 2013/0020929 | A1* | 1/2013 | van de Ven | H01L 25/0753 313/498 |
| 2013/0114242 | A1* | 5/2013 | Pickard | F21V 9/16 362/84 |

FOREIGN PATENT DOCUMENTS

| | | | |
|---|---|---|---|
| JP | 2008288183 | A | 11/2008 |
| JP | 2009117346 | A | 5/2009 |
| JP | 3153766 | U | 9/2009 |
| JP | 2009277586 | A | 11/2009 |
| WO | 2010099755 | A1 | 9/2010 |

OTHER PUBLICATIONS

U.S. Appl. No. 13/943,152, filed Jul. 16, 2013.

* cited by examiner

HIGH EFFICIENCY LED LAMP

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

SUMMARY OF THE INVENTION

In some embodiments an LED lamp comprises a plurality of red LEDs and a plurality of blue LEDs and a phosphor covering at least the plurality of blue LEDs, where the lamp has a lumens per watt of at least 200 in a steady state operation.

The plurality of blue LEDs and the plurality of red LEDs may be operated from a single driver. The plurality of blue LEDs and the plurality of red LEDs may be mounted in a plurality of LED components where each of the LED components comprising at least one blue LED and at least one red LED. The plurality of LED components may extend in a linear path. The at least one blue LED and the at least one red LED may be mounted on a substrate. The substrate may have a surface that is exposed to the light generated by the at least one blue LED and the at least one red LED where the exposed surface of the substrate may be covered in a reflective material. The reflective material may comprise white reflective paint. The substrate may comprise a printed circuit board. The LED component may comprise two blue LEDs and two red LEDs. The plurality of LED components may be mounted on a printed circuit board. The blue LEDs may comprise LEDs that produce approximately 745000 μW at 350 mA with a dominant wavelength between approximately 448 and 453 nm. The red LEDs may comprise LEDs that produce approximately 167 lumens per watt at 30 mA with a dominant wavelength between 608 and 614 nm. The plurality of blue LEDs and the plurality of red LEDs may be connected in a single string. Each of the plurality of LED components may be covered in a phosphor globe or a single phosphor dome may cover all of the LED components. The phosphor globe and/or dome may comprise a narrow green Barium Orthosilicate phosphor. The globe and or dome may be made of quartz. The globe may be substantially spherically shaped. A light diffusing lens may cover the LED components. White light may be generated having a CRI of approximately 80. The luminous flux generated by the lamp may be at least 3000. The lamp may have a Duv of 0.002095. The lamp may have a S/P ratio of 1.25. The lamp may have a correlated color temperature (CCT) of approximately 3079. The lamp may have a color rendering index (CRI) of at least 79. The lamp may have a dominant wavelength of 581 nm with a peak wavelength at 616 nm. The LED components may comprise four red LEDs and two blue LEDs. The red LEDs may be positioned outside of the phosphor globes.

DETAILED DESCRIPTION

Figure 1:
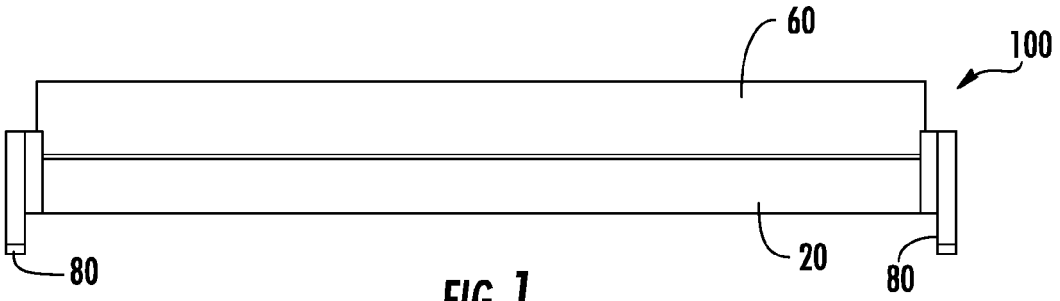
FIG. 1 is a side view showing an embodiment of a LED lamp of the invention.
Figure 2:
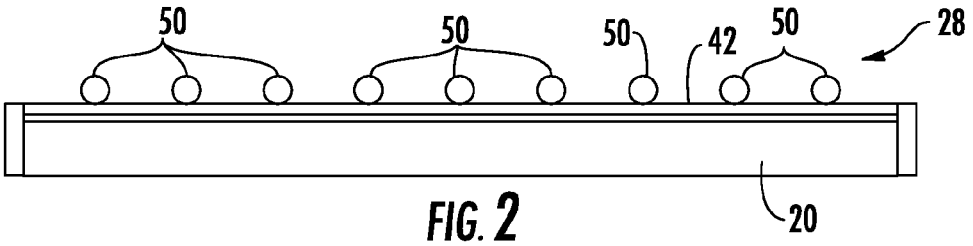
FIG. 2 is a side view of the lamp of FIG. 1 with the diffuser lens removed.
Figure 3:
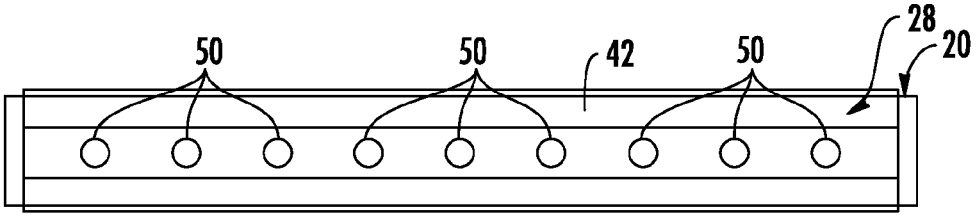
FIG. 3 is a top view of the lamp as shown in FIG. 2.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

The LED lamp 100, shown in for example FIG. 1, comprises a base 20. The base 20 may be constructed of thermally conductive material such as aluminum where the base 20 forms part of the heat sink for dissipating heat generated by the LEDs to the ambient environment. While the base is shown as having a generally cylindrical shape, the base 20 may have any suitable shape and size. The base 20 may be supported on separate brackets 80 where the brackets 80 may be secured to a supporting surface such as a wall, ceiling or other surface. The brackets 80 may be rigidly attached to the base 20 or the base 20 may be mounted for rotation relative to the brackets 80. Other mechanisms for supporting the lamp may also be used including a mounting structure formed integrally with the base.

The electrical circuitry 40 for powering the LEDs including the power supply, drivers, other electrical circuitry and electrical connectors may be mounted inside of the base 20. The power supply comprises electrical connectors 44 for connecting the power supply, driver and other components to an AC power supply. In one embodiment the connectors 44 comprise wires that may be connected to an existing AC power supply. The wires 44 may terminate in electrical connectors 46 or separate electrical connectors may be used to connect the electronics of the LED fixture 100 to an AC power supply. The lamp electronics 40 are connected to LEDs of LED array 30 by electrical conductors 48 such as wires, traces on a PCB board or the like to provide an electrical connection between the electrical circuitry 40 and the LEDs. The lamp electronics in some embodiments are at least 90% efficient and may be approximately 95% efficient.

Figure 4:
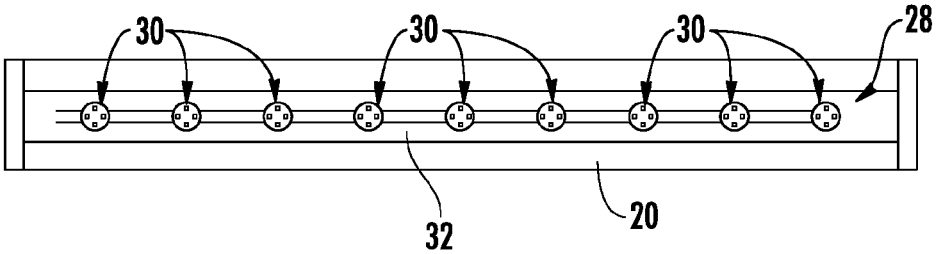
FIG. 4 is a top view of the lamp similar to FIG. 3 with the cover removed.
Figure 5:
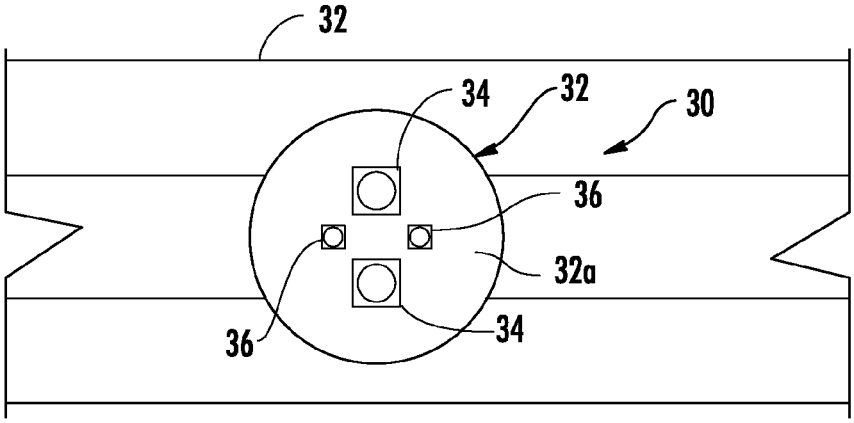
FIG. 5 is a top view of a LED assembly used in the lamp of FIG. 1.

The LED lamp 100 comprises an LED array 28 that may be supported by and secured to the base 20. The LED array 28 may comprise a plurality of LED components 30 where each LED component comprises LEDs or LED packages 34, 36 as shown in FIGS. 4 and 5. The LED components 30 may be arranged in a line along a linear path and the LED array 28 may extend the length of, or substantially the length of, the base 20 to create a desired light pattern. The LEDs may be arranged such that the light pattern extends the length of, or for a substantial portion of the length of, the lamp 100 and may be similar in length to a traditional fluorescent bulb. While in one embodiment the LEDs extend for substantially the entire length of the base 20, the LEDs may be arranged in other patterns and may extend for less than substantially the entire length of the base if desired. In the illustrated embodiment the lamp is configured such that it has an elongated form factor that may be used as a replacement for a fluorescent fixture or light. In other embodiments the lamp may have other configurations.

The LEDs 34, 36 may be mounted on a substrate 32 such as a printed circuit board (PCB) that provides physical support for the LEDs and provides an electrical path for providing electrical power to the LEDs. The exposed surface of the substrate 32, except for LEDs 34, 36, is preferably covered in a reflective material. In one embodiment the reflective material 32*a* comprises white reflective paint that is applied over the substrate 32 in the area of LEDs 34, 36. The white paint, or other reflective material 32*a*, may be applied in the area adjacent the LEDs that is disposed inside of the globes 50 to reflect light emitted from the LEDs 34, 36. The substrate 32 may comprise a PCB or other similar support that supports the individual LED components and provides the electrical connection from the power supply 40 to the LED components 30. The exposed surface of the PCB 32 and base 20 external to the globes 50 may also be covered in a reflective surface. In one embodiment the PCB 32 and base 20 may be covered by a white aluminum plate or plates 42. In other embodiments the exposed surfaces of the base 20 and PCB 38 may be made of or covered in a reflective material such as MCPET, white optic, or the like, to efficiently reflect light from the mixing chamber. The plate 42 may be applied to the base 20 and substrate 38 with "cutouts" provided to expose the LED components 30. The entire base may be made of a reflective material or portions of the base may be made of reflective material. For example, portions of the base that may reflect light may be made of reflective material such as white reflective aluminum while the remainder of the base may comprise other materials including non-reflective materials.

Figure 7:
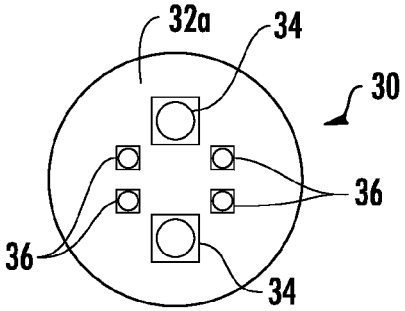
FIG. 7 is a top view of an alternate embodiment of a LED assembly used in the lamp of the invention.

The LEDs and/or LED packages used with an embodiment of the invention may include light emitting diode chips that emit hues of light that, when mixed, are perceived in combination as white light. A lighting system using the a combination of blue shifted yellow (BSY) and red LED devices to make substantially white light can be referred to as a BSY plus red or "BSY+R" system. In such a system, the LED devices used include LEDs operable to emit light of two different colors. In one example embodiment, the LED devices include a group of LEDs that form the LED component 30, where each group of LEDs comprises red and blue LEDs arranged under a phosphor globe 50. In one embodiment the LED package comprises two blue LEDs 34 and two red LEDs 36. The blue LEDs 34 may comprise LEDs that produce approximately 745000 μW at 350 mA with a dominant wavelength between approximately 448 and 453 nm. The red LEDs 36 may comprise LEDs that produce approximately 167 lumens per watt (LPW) at 30 mA with a dominant wavelength between 608 and 614 nm. In one embodiment the LED chips are covered by a silicone lens such as a lens made by THE DOW CHEMICAL COMPANY and sold under the name OE6652. The LED component 30 comprises the two red LEDs 36 and two blue LEDs 34 mounted on an electrically conductive substrate 32 that forms part of the electrical path to the LEDs. The LEDs 34, 36 are connected in a single string. Because the red LEDs and the blue LEDs operate at different peak efficiencies the overall efficiency of the lamp may be increased by running each type of the LEDs at or near their respective peak efficiencies. In one embodiment using four red LEDs 36 with two blue LEDs 34 in each LED component 30, as shown in FIG. 7, allows each type of LED to operate near their respective peak wall-plug efficiency (WPE).

A phosphor is used with the LED components 30 to generate light at a desired perceived color. In one embodiment white light is generated having a CRI of approximately 80. The phosphor 52 may be coated on a globe 50 where one globe 50 is provided for each LED component 30. The phosphor may comprise narrow green Berium Orthosilicate (BOSA) phosphor. One suitable phosphor is sold by MERCK under the part no. RGA555. The globe 50 may comprise a quartz globe. The globe 50 may comprise a substantially spherical shaped globe that is disposed over the LED component 30 such that substantially all of the light from the LEDs 34, 36 is emitted through the phosphor globe 50. The globe may be mounted to the substrate 32 and/or to the cover 42. The phosphor 52 may be applied to globe 50 using a fill and dip process. While the globe 50 is described as being spherically shaped the globe may have other shapes.

Figure 8:
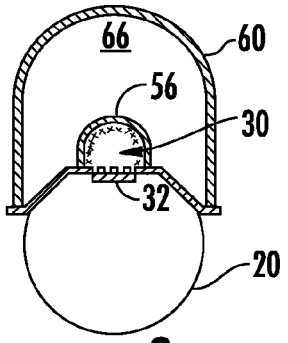
FIG. 8 is a partial section view of an alternate embodiment of the lamp of the invention.
Figure 9:
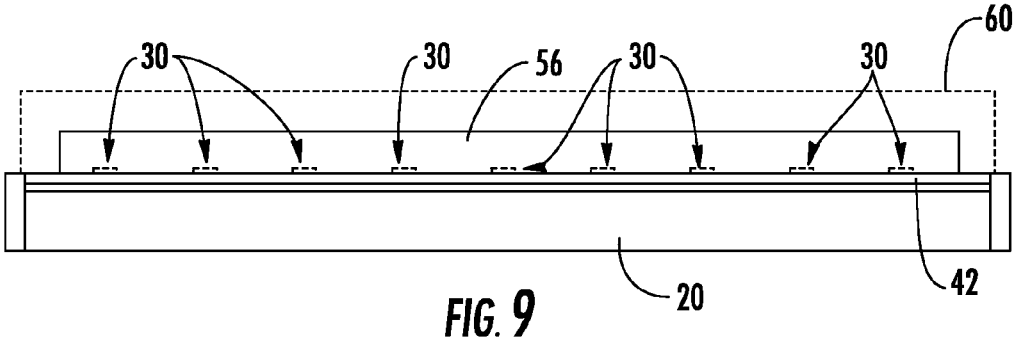
FIG. 9 is a side view of the lamp of FIG. 8 with the diffuser lens removed.
Figure 10:
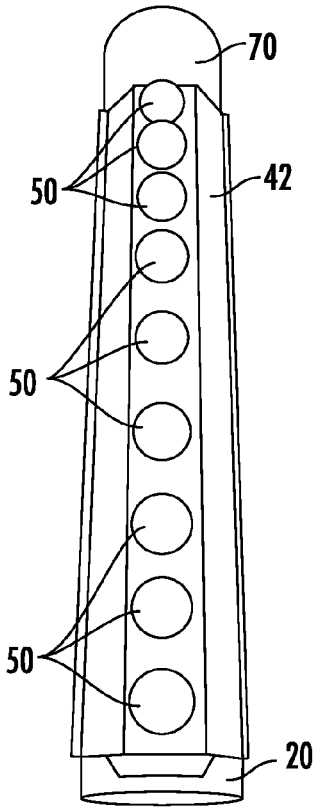
FIG. 10 is a perspective view of the lamp of FIG. 1.

In an alternate embodiment a single phosphor dome 56 may be used to cover all of the LED components 30 as shown in FIGS. 8 and 9. The dome 56 may comprise a quartz semi-spherical tube that has a generally inverted U cross-sectional shape, or a semicircular or hemicircular cross-sectional shape. The dome 56 is arranged such that the longitudinal edges are mounted to the substrate 30, cover 42 and/or the housing 20 with the LED components 30 spaced along the length of the dome 56.

A lens 60 may be connected to the cover 42 and/or base 20 to cover the LED arrays 30 and phosphor dome/globes and create a mixing chamber 66 for the light emitted from the globes 50. The lens 60 diffuses and mixes the light from the LEDs 34, 36 to provide as uniform, diffuse, color mixed light pattern. The lens 60 may be made of molded plastic or other material and may be provided with a light diffusing layer. The light diffusing layer may be provided by etching, application of a coating or film, by the translucent or semitransparent material of the lens, by forming an irregular surface pattern during formation of the lens or by other methods. In one embodiment the diffuser lens 60 comprises a 3030 diffuser manufactured by BRIGHT VIEW TECHNOLOGIES CORPORATION.

Figure 6:
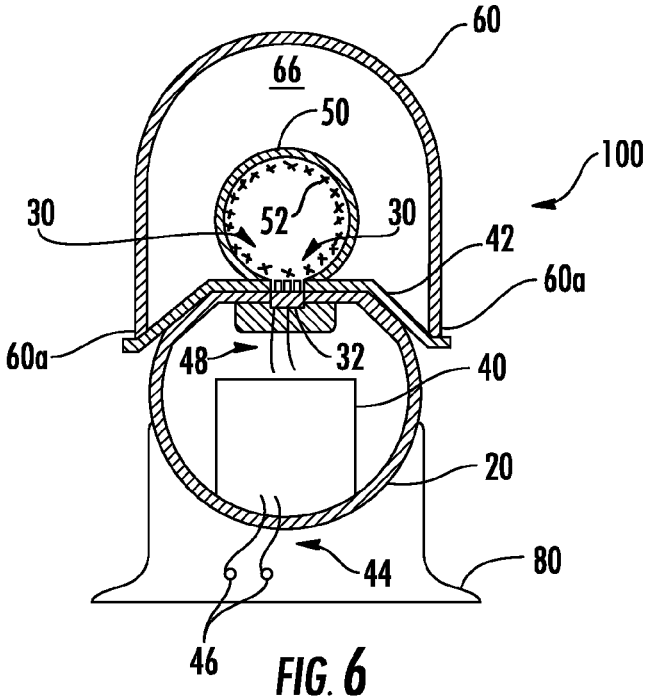
FIG. 6 is a section view of the fixture of FIG. 1.

In some embodiments the lens 60 has a cross-sectional U-shape as shown for example in FIG. 6. The lens 60 extends the length of the base 20 to cover the LEDs 34, 36 and the phosphor globes/dome supported on the base 20. In one embodiment a relatively thin flexible material may be used that is bent to form the curved lens. In some embodiments, the longitudinal edges 60*a* of the lens 60 may be located in longitudinal channels formed along the longitudinal edges of the cover 42 or base 20. In some embodiments, the channels may be formed as one-piece with the cover 42 or base 20; however, the channels may be separately attached to the base or cover. The longitudinal edges of the lens 60*a* may be inserted into the channels to retain the lens 60 on the base 20. Other mechanisms for attaching the lens to the base 20 may also be used.

End caps 70 may be provided at the opposite ends of the lens 60 to close the interior mixing chamber 66 of LED lamp 100. The end caps 70 may be made of a transparent or translucent material to allow light to exit the lamp from the mixing chamber through the end caps or the end caps may be made of a reflective material such as white plastic to reflect light back into the light mixing chamber and out of the lens 60. The end caps 70 may be connected to the base 20, cover 42 and/or to the lens 60, or the end caps may be formed integrally with the lens 60. The end caps 70, base 20, cover 42 and lens 60 may be connected to one another using other mechanisms such as adhesive, mechanical connectors, welding, friction fit or the like.

A lamp as described herein is extremely efficient and has a very high lumens per watt steady state performance. A steady state operation as used herein means that the lamp is operating at thermal equilibrium. In order to establish the performance characteristics of the lamp an embodiment of the lamp described herein was tested and evaluated. The test was conducted with the lamp in a light-up position supported on mounting brackets inside of a sphere. The sphere was a 2*m* sphere calibrated using a tungsten halogen omni-directional 75 W calibration lamp. Measurements were taken using a CCD array spectrometer. The test methods used are described below:

| Title | Description |
|---|---|
| ANSI C82.77: 2002 | Harmonic Emission Limits -Related Power Quality Reqt's for Lighting Equipment |
| CIE Pub. 13.3: 1995 | Method of Measuring and Specifying Color Rendering of Light Sources |
| CIE Pub. 15: 2004 | Colorimetry |
| IES LM-58: 1994 | Spectroradiometric Measurements |
| IES LM-65: 2001 | Single-Ended Compact Fluorescent Lamps - Life Test Performance |
| IES LM-79: 2008 | Electrical and Photometric Measurements of Solid-State Lighting Products |

The lamp was measured at 220 mA (power supply unit output) using a power supply with 94.7% efficiency at approximately 70V. The lamp used a single string of nine LED arrays 30 where each array 30 comprised two blue and two red LED chips as previously described. TiO2 in SI3 white paint was screen-printed on substrate 32 to create reflective area 32*a*. The LEDs 34, 36 were die attached to the substrate 32. The phosphor dome for each LED component comprised a quartz globe 50 coated with a narrow green RGA555 phosphor 52 that was fill and dump coated on the quartz globe. The LED components were mounted on a two foot long linear housing with a white aluminum reflector plate 42. A diffuser lens 60 was mounted to the housing covering the LED components. The diffuser lens 60 comprised a 3030 diffuser manufactured by BRIGHT VIEW TECHNOLOGIES CORPORATION.

The luminous flux generated by the lamp as tested was 3290 Lumens with a luminous efficacy of 203.1 Lumens/Watt. The efficacy of a single LED component of four LEDs in phosphor globe 50 was approximately 211.6 Lumens/Watt. The lamp had a Duv of 0.002095 and an S/P ratio of 1.25. This photometric data was achieved in a steady state condition 60 minutes at an ambient temperature of 25.3° C. In at least some embodiments, the lamp has a lumens per watt of at least 200 in a steady state operation, a color temperature range of about 3000 k, and within 10 MacAdam ellipses of the Black Body locus.

The correlated color temperature (CCT) of the lamp was 3079 with a color rendering index (CRI) of 79.28 and a R9 score of −26.86. The Color rendering index details are provided below.

| Ra | R1 | R2 | R3 | R4 | R5 | R6 | R7 | R8 | R9 | R10 | R11 | R12 | R13 | R14 |
|---|---|---|---|---|---|---|---|---|---|---|---|---|---|---|
| 79.3 | 85.3 | 86.0 | 83.1 | 83.8 | 79.6 | 81.3 | 83.6 | 51.6 | −26.9 | 58.7 | 79.9 | 48.6 | 84.8 | 87.8 |

Figure 11:
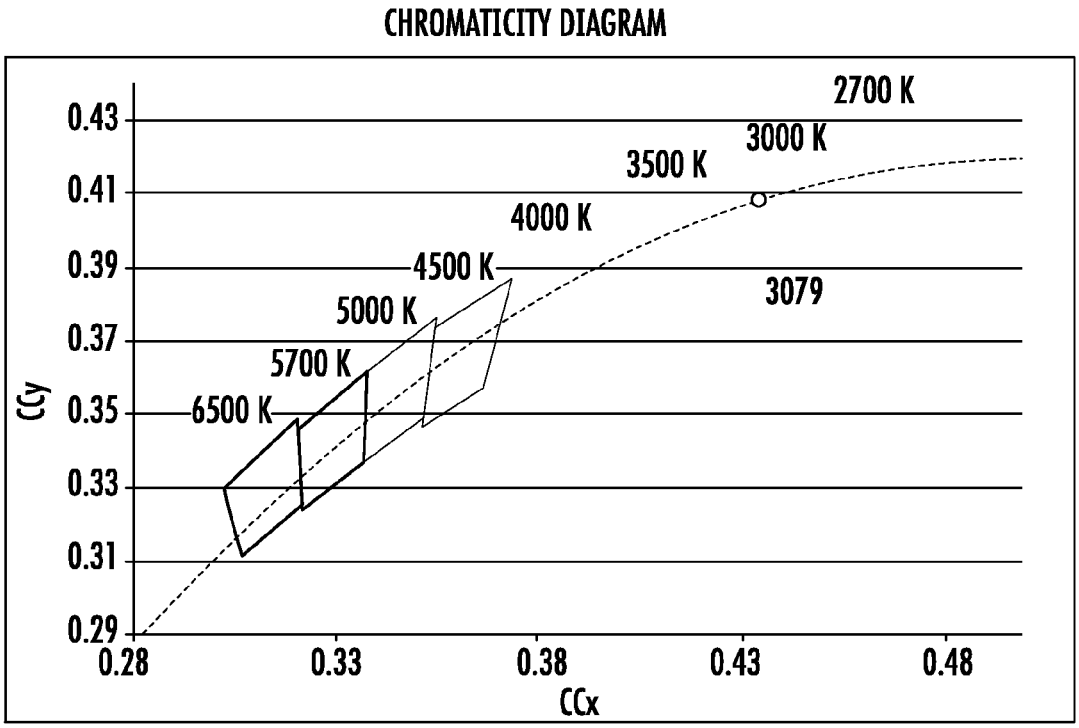
FIG. 11 is a chromacity diagram for an embodiment of the lamp of the invention.

The chromacity coordinates are provided below and the chromacity diagram for the lamp is shown in FIG. 11.

| x | y | u | v | u' | v' | Duv |
|---|---|---|---|---|---|---|
| .4342 | .4083 | .2470 | .3484 | .2470 | .5226 | 0.002095 |

Figure 12:
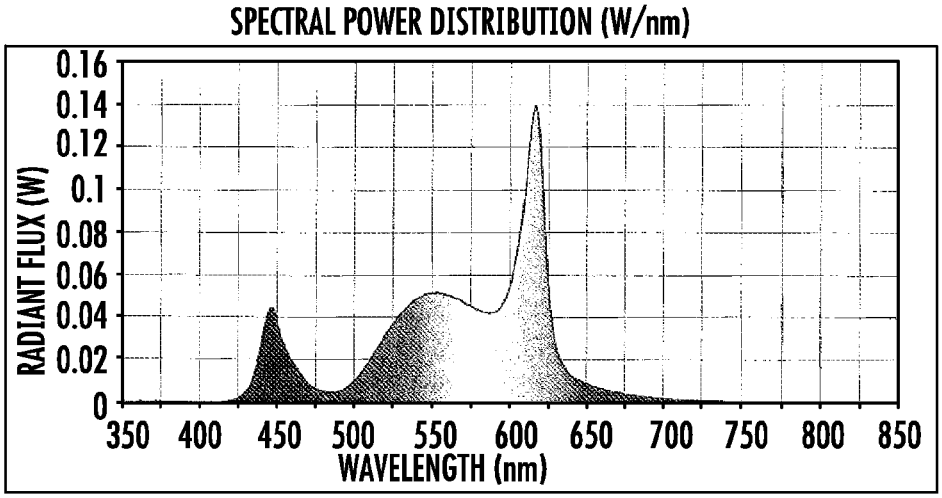
FIG. 12 is a spectral distribution graph for an embodiment of the lamp of the invention.

The lamp has a dominant wavelength of 581 nm with a peak wavelength at 616 nm. The spectral distribution (W/nm) is shown below and the spectral distribution graph is shown in FIG. 12.

| Spectral Distribution | |
|---|---|
| ˆ(nm) | W/nm |
| 360 | 0.000032 |
| 370 | 0.000130 |
| 380 | 0.000095 |
| 390 | 0.000093 |
| 400 | 0.000034 |
| 410 | 0.000052 |
| 420 | 0.000693 |
| 430 | 0.004785 |
| 440 | 0.028199 |
| 450 | 0.038088 |
| 460 | 0.019041 |
| 470 | 0.008364 |
| 480 | 0.004947 |
| 490 | 0.005042 |
| 500 | 0.010129 |
| 510 | 0.019943 |
| 520 | 0.031725 |
| 530 | 0.041994 |
| 540 | 0.048842 |
| 550 | 0.051485 |
| 560 | 0.050577 |
| 570 | 0.047346 |
| 580 | 0.043531 |
| 590 | 0.042409 |
| 600 | 0.055938 |
| 610 | 0.105764 |
| 620 | 0.107932 |
| 630 | 0.025297 |
| 640 | 0.012474 |
| 650 | 0.008625 |
| 660 | 0.006388 |
| 670 | 0.004744 |
| 680 | 0.003569 |
| 690 | 0.002636 |
| 700 | 0.001960 |
| 710 | 0.001472 |
| 720 | 0.001077 |
| 730 | 0.000812 |
| 740 | 0.000592 |
| 750 | 0.000413 |
| 760 | 0.000313 |
| 770 | 0.000227 |
| 780 | 0.000158 |
| 790 | 0.000107 |
| 800 | 0.000067 |
| 810 | 0.000048 |
| 820 | 0.000012 |
| 830 | 0.000002 |

The electrical measurements for the test were taken at 120 VAC. The input Wattage was measured at 16.20 W, the input current was measured at 0.305 amps and the input voltage was measured at 120.02 Volts. The power factor was 0.443 and the off-state power was 0 watts. The total harmonic distortion of the Voltage was 0.34% and the total harmonic distortion of the Amperage was 194.80%.

In some embodiments the luminous efficacy of the lamp may be increased by making each LED component with four red LEDs and two blue LEDs to allow both types of LEDs to be run at peak wall-plug efficiency (WPE). The luminous efficiency may also be increased by providing a different globe coating or by using a more efficient power supply. Further, increases in luminous efficiency may be achieved by locating the red LEDs outside of the phosphor globes. With the red LEDs outside of the phosphor globes color mixing may be enhanced by additional optics. In some embodiments the LPW for the lamp may be increased to over 210 LPW and in some embodiments an LPW of about 213 LPW can be obtained.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A LED lamp comprising:

a plurality of red LEDs and a plurality of blue LEDs, a phosphor covering at least the plurality of blue LEDs, where the lamp has a lumens per watt of at least 200 in a steady state operation.

2. The lamp of claim 1 where the plurality of blue LEDs and the plurality of red LEDs are operated from a single driver.

3. The lamp of claim 1 wherein the plurality of blue LEDs and the plurality of red LEDs are mounted in a plurality of LED components, each of the LED components comprising at least one blue LED and at least one red LED.

4. The lamp of claim 3 wherein the plurality of LED components extend in a linear path.

5. The lamp of claim 3 wherein the at least one blue LED and the at least one red LED are mounted on a substrate.

6. The lamp of claim 5 wherein the substrate has a surface that is exposed to the light generated by the at least one blue LED and the at least one red LED, the exposed surface of the substrate being covered in a reflective material.

7. The lamp of claim 6 wherein the reflective material comprises white reflective paint.

8. The lamp of claim 5 wherein the substrate comprises a printed circuit board.

9. The lamp of claim 3 wherein the LED component comprises two blue LEDs and two red LEDs.

10. The lamp of claim 3 wherein the plurality of LED components are mounted on a printed circuit board.

11. The lamp of claim 3 wherein each of the plurality of LED components are covered in a phosphor globe.

12. The lamp of claim 11 wherein the phosphor globe comprises a narrow green Barium Orthosilicate phosphor.

13. The lamp of claim 11 wherein the globe comprises a quartz globe.

14. The lamp of claim 11 wherein the globe is substantially spherically shaped.

15. The lamp of claim 3 further comprising a light diffusing lens covering the LED components.

16. The lamp of claim 1 wherein the blue LEDs comprise LEDs that produce approximately 745000 μW at 350 mA with a dominant wavelength between approximately 448 and 453 nm.

17. The lamp of claim 1 wherein the red LEDs comprise LEDs that produce approximately 167 lumens per watt at 30 mA with a dominant wavelength between 608 and 614 nm.

18. The lamp of claim 1 wherein the plurality of blue LEDs and the plurality of red LEDs are connected in a single string.

19. The lamp of claim 1 wherein the phosphor is provided on a dome where all of the plurality of blue LEDs are under the dome.

20. The lamp of claim 1 wherein white light is generated having a CRI of approximately 80.

21. The lamp of claim 1 wherein the luminous flux generated by the lamp is at least 3000.

22. The lamp of claim 1 wherein the lamp has a Duv of 0.002095.

23. The lamp of claim 1 wherein the lamp has a S/P ratio of 1.25.

24. The lamp of claim 1 wherein the lamp has a correlated color temperature (CCT) of approximately 3079.

25. The lamp of claim 1 wherein the lamp has a color rendering index (CRI) of at least 79.

26. The lamp of claim 1 wherein the lamp has a dominant wavelength of 581 nm with a peak wavelength at 616 nm.

27. The lamp of claim 3 wherein the LED components comprise four red LEDs and two blue LEDs.

28. The lamp of claim 14 wherein the red LEDs are positioned outside of the phosphor globes.

29. A LED lamp comprising:

a plurality of red LEDs and a plurality of blue LEDs, a phosphor covering at least the plurality of blue LEDs, where the lamp has a lumens per watt of at least 200 in a steady state operation, a color temperature range of about 3000 k, and within 10 MacAdam ellipses of the Black Body locus.

* * * * *